US005402664A

United States Patent [19]

Sarver et al.

[11] Patent Number: 5,402,664

[45] Date of Patent: Apr. 4, 1995

[54] WIRE DRAWING DIE ASSEMBLY

[75] Inventors: Douglas R. Sarver, Kingsville; Gaylord L. Sarver, Havre De Grace, both of Md.

[73] Assignee: Paramount Die Co., Inc., Belcamp, Md.

[21] Appl. No.: 3,480

[22] Filed: Jan. 12, 1993

[51] Int. Cl.[6] ..... B21C 3/14

[52] U.S. Cl. ..... 72/467; 72/282

[58] Field of Search ..... 72/467, 282, 278, 274

[56] References Cited

U.S. PATENT DOCUMENTS

| | | | |
|---|---|---|---|
| 1,684,102 | 9/1928 | Leustig | 72/467 |
| 1,896,674 | 1/1931 | Longwell . | |
| 2,028,652 | 6/1934 | Mulatier . | |
| 2,109,312 | 6/1936 | Dimmick . | |
| 2,539,716 | 7/1948 | Bairstow et al. . | |
| 3,145,832 | 8/1964 | Case | 72/467 |
| 3,526,115 | 9/1967 | Armstrong et al. . | |
| 3,740,990 | 6/1973 | Prajsnar et al. . | |

FOREIGN PATENT DOCUMENTS

| | | | |
|---|---|---|---|
| 175497 | 3/1986 | European Pat. Off. | 72/467 |
| 142511 | 7/1980 | Germany | 72/467 |
| 27315 | 4/1910 | United Kingdom | 72/467 |
| 549407 | 11/1942 | United Kingdom | 72/467 |
| 1416228 | 8/1988 | U.S.S.R. | 72/467 |
| 1666240 | 7/1991 | U.S.S.R. | 72/467 |

*Primary Examiner*—Daniel C. Crane

*Attorney, Agent, or Firm*—Jacobson, Price, Holman & Stern

[57] ABSTRACT

A wire drawing die assembly has removable pressure and draw nibs held in screw-together holders. The pressure nib projects somewhat from its holder and presses the draw nib into a converging passageway in the draw nib holder. A lubricant pressure chamber is formed between the nibs for lubricant which is introduced through the front end of the pressure nib. When the draw nib becomes worn, the holders can be separated and the worn nib can be readily replaced.

8 Claims, 2 Drawing Sheets

WIRE DRAWING DIE ASSEMBLY

BACKGROUND OF THE INVENTION

This invention relates to a die assembly for the cold drawing of wire and/or bar stock.

In wire drawing processes, it is common practice continuously to draw the wire stock through a die assembly which includes a pressure die followed by a drawing die which performs the sizing operation on the wire. Lubricant for the drawing die may be forced under pressure into a pressure chamber defined between the respective dies.

In assemblies of the above kind, the die nibs usually are cold pressed, heat shrunk or brazed into respective metal casings with an interference fit. Each die is then accurately sized to a required internal diameter. The casings are themselves held in a die box.

When a die becomes worn, it is resized by machining to a larger internal diameter and the die can then be reused for wire stock of a larger diameter. Clearly, resizing can only be repeated a limited number of times for each die assembly, which is then discarded.

SUMMARY OF THE INVENTION

It is an object of the invention to provide novel wire drawing die assemblies and systems providing overall simplifications and economics in long term operation compared with known assemblies and systems.

It is a further object of the invention to provide a die assembly of the kind referred to in which respective die nibs can be removed from and replaced in the respective holders, so that the holders can be reused on a longer term basis than with conventional assemblies wherein the nibs are substantially permanently attached therein.

Another object of the invention is to provide a novel die assembly including a pressure nib, a pressure nib holder, a drawing nib and a drawing nib holder all of which can be easily assembled together for use and taken apart after a nib is worn, so that the nib can be replaced and the parts reassembled.

Still another object of the invention is to provide a die assembly as above, wherein the pressure nib holds the draw nib in its holder and the draw nib is forced in tightly by the draw of the wire during use, and wherein a pressure chamber for lubricant is defined between the respective nibs for the supply of lubricant through the pressure nib itself.

In fulfillment of the above and other objects, the invention provides a wire drawing die assembly wherein a carbide, steel, ceramic or like pressure nib having a plane cylindrical outer surface fits loosely in a cylindrical bore at the rear (downstream) end of a steel pressure nib holder or cap with the back or rear face of the pressure nib projecting somewhat from the back face of the cap holder. The cylindrical bore in the holder opens from a converging lubricant intake with a shoulder therebetween, against which the front or upstream end of the pressure nib abuts. The back end of the pressure nib holder is threaded and fits into a threaded cylinder forming the front end of a steel draw nib base holder. The threaded cylinder opens into a tapering passage at the back end of the base holder which receives the draw nib. The carbide or diamond draw nib has a tapering outer diameter to conform with the tapering passage. When the pressure nib cap holder is threaded into the draw nib base holder, the projecting back end of the pressure nib presses the draw nib more tightly into the tapering passage and the tightening action is augmented during wire drawing by the passage of the wire stock.

The pressure nib and draw nib are configured and shaped at their back and forward ends respectively to define a lubricant pressure chamber and during the drawing process lubricant is introduced to the pressure chamber through the front of the pressure nib itself. Thus, the inner diameter of the pressure nib relative to the wire diameter is effective in controlling the lubricant pressure and it is not necessary to provide additional mechanical means for pressure maintenance.

To improve the seal between the nibs where this may be needed in certain high pressure applications, the projecting back end of the pressure nib may be tapered and fit in a correspondingly tapered recess in the front end of the tapered passage through the draw nib base, thus forming a secondary seal while the pressure nib still presses the draw nib into the tapered passage.

When a draw nib becomes worn, the respective nib holders can be unthreaded and the worn draw nib can be readily tapped from the tapered passage for replacement. Thus, the holders can be used on a longer term basis than with known systems. It is also found that the nibs themselves wear less quickly than in the known systems.

In a preferred form of the invention, the draw nib holder or base may have a frusto-conically shaped outer profile which converges in the wire drawing direction to fit a similarly shaped seat in a die box, whereby the drawing operation again tends to tighten the fit of the base in its seat and thereby eliminate the need for complicated and expensive die box designs having mechanical fasteners for securing the base in the die box.

Additional features and advantages of the invention will become apparent from the ensuing description and claims read in conjunction with the accompanying drawing.

DESCRIPTION OF PREFERRED EMBODIMENTS

Figure 1:
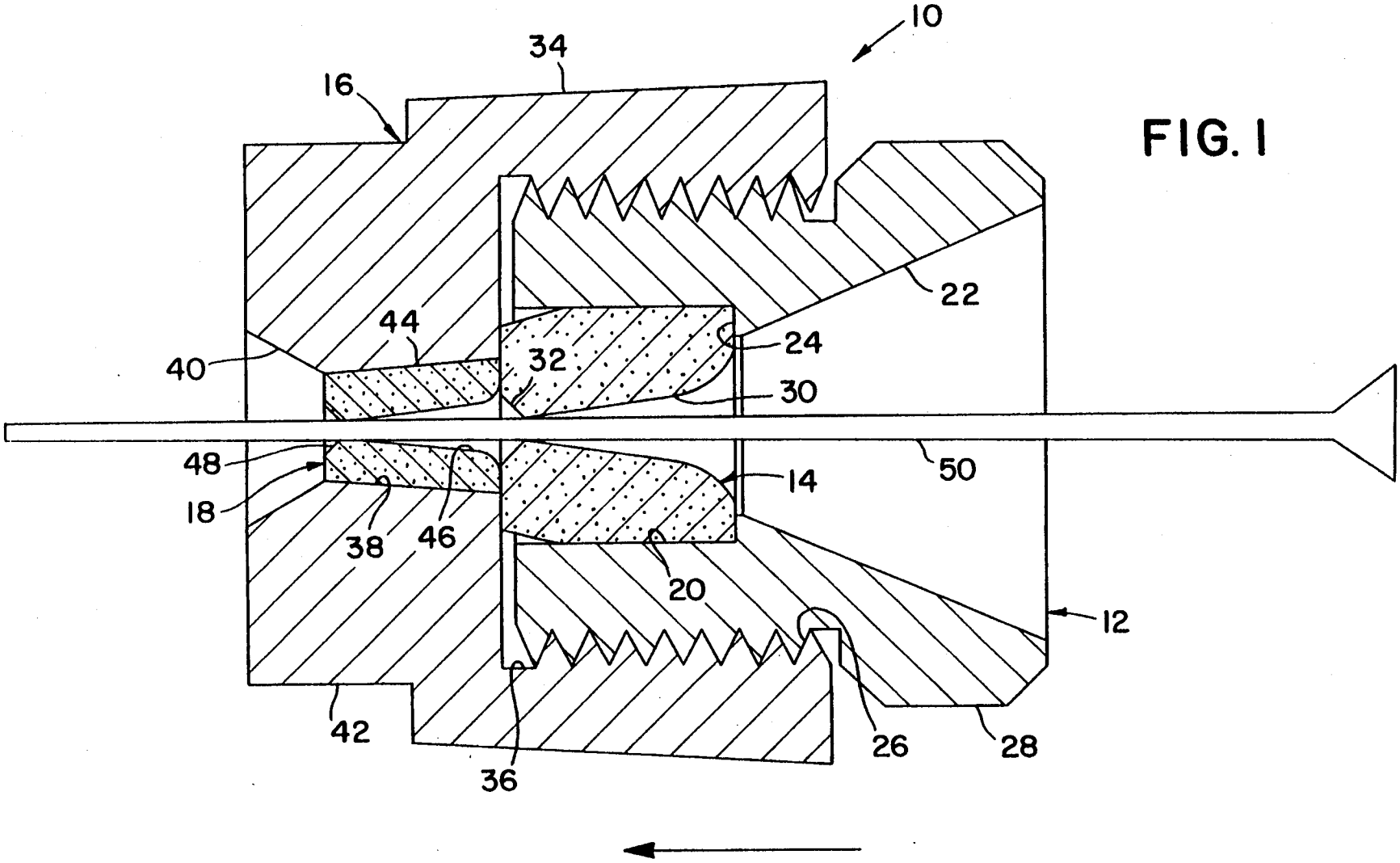
FIG. 1 is a cross-sectional view through a wire drawing die assembly according to the invention.

As shown in FIG. 1, a wire drawing die assembly 10 according to the invention, for use in a die box (not shown,) comprises a steel pressure NIB holder of cap 12, a carbide, steel, ceramic or diamond pressure nib 14, a steel draw NIB holder or base 16, and a carbide or diamond draw nib 18. The wire drawing direction is indicated by an arrow.

The pressure nib holder 12 has a cylindrical bore 20 at its rear end leading from a convergent lubricant inlet 22 at the front end of the holder. A shoulder 24 is formed between the bore 20 and the lubricant inlet. The rear end of holder 12 has an external thread 26 and the front end may have an hexagonal or like outer profile 28 for facilitating threading of the cap holder 12 into and from base holder 16.

The pressure nib 14 has a cylindrical outer profile and is a relatively loose fit in bore 20. When the front end of nib 14 abuts shoulder 24, its rear end projects somewhat from the rear end of holder 12. Nib 14 has a central throughbore with a converging inlet portion 30 and a diverging outlet portion 32.

Draw nib base holder 16 has a frusto-conical outer surface 34 which converges in the wire drawing direction to simplify die box design as noted above, and a threaded cylinder 36 at its front end to receive the threaded back end of the pressure nib holder. A converging tapering passage 38 extends forwardly from cylinder 36 to receive the draw nib 18, and passage 38 communicates with a diverging outlet 40. At its rear end, the draw nib holder may have an hexagonal or like outer profile 42 also to facilitate threading and unthreading of the holders.

The draw nib 18 has a tapering (frusto-conical) outer surface 44 for receipt in passage 38, the front end of the draw nib preferably being of marginally larger diameter than the back end of the passage to assure that when assembled, there will always be contact between the back end face of the pressure nib and the front end face of the draw nib. Internally, the draw nib has a through bore with a converging inlet portion 46 and a diverging outlet portion 48. The smallest diameter of the bore is the nominal drawing diameter of the wire.

When the holders are threaded together as shown, the pressure nib engages against shoulder 24 and presses the draw nib tightly into passage 38 without any attachment means being needed for the nibs. When the draw nibs becomes worn, the holders 12 and 16 can be unthreaded and the draw nib can be tapped out of passage 38 for ready replacement.

During wire drawing, lubricant is introduced through inlet 22 by means of the drawn wire itself and converging bore portion 30 to a pressure chamber which is formed by the diverging bore portion 32 of the pressure nib and the converging bore portion 46 of the draw nib. The pressure level developed by the lubricant trapped in the pressure chamber will be dependent on the diameter difference between the wire stock 50 being drawn and the narrowest portion of the throughbore in the pressure nib.

The invention is applicable to a wide range of die sizes and it is evident that it provides for simple replacement of worn die nibs and optimal usage of the holders.

It is found that in certain high pressure applications, particularly when drawing high carbon wires, lubricant may tend to leak somewhat from between the nib interface. The assembly shown in FIG. 2 obviates this occurrence by forming a secondary seal between the nibs.

Figure 2:
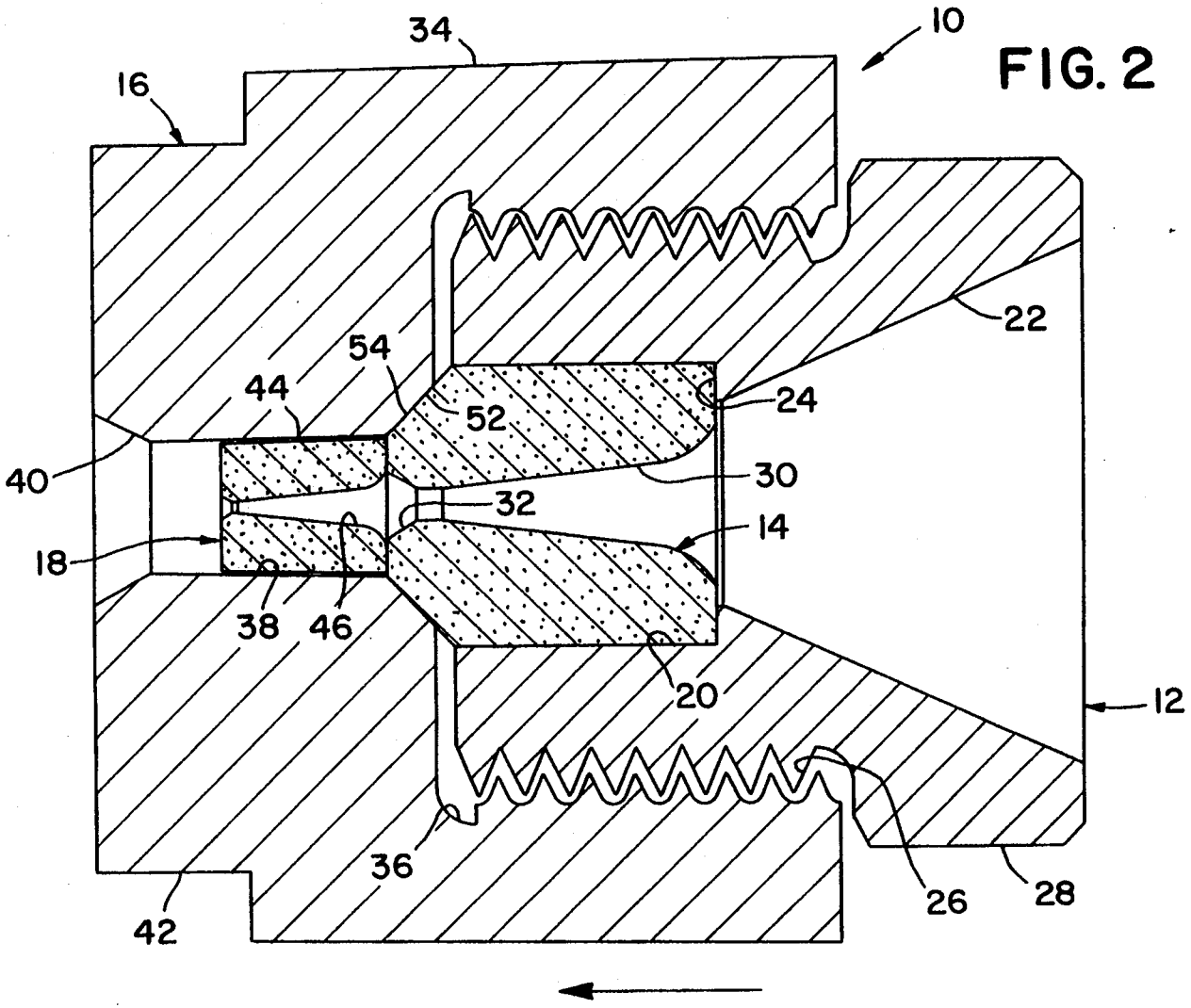
FIG. 2 is a view similar to FIG. 1 of a modified die assembly.

As shown in FIG. 2, the back end 52 of the pressure nib 14 has a tapered outer surface which seals in a tapered recess 54 at the front end of passage 38 in the draw nib base 16. Preferably, to ensure a seal, the pressure nib and recess are differentially tapered. For example, the recess 54 may have a 90° taper and the pressure nib an 88° taper. In this arrangement, the back end of the pressure nib again presses the draw nib tightly into passage 38 when assembled and provides a primary seal between the nibs, with the tapered surfaces of the pressure nibs and recess 54 providing the secondary seal. The assembly of FIG. 2 is in other respects similar to that of FIG. 1.

In another embodiment of the invention, where only a draw nib assembly is required, the pressure nib and holder of the embodiment may be replaced by a threaded cap arrangement which applies pressure to the FRONT end of the draw nib to retain same in passage 38 in a similar way.

While only preferred embodiments of the invention have been described herein in detail, the invention is not limited thereby and modifications are possible within the scope of the attached claims.

We claim:

1. A wire drawing die assembly which includes a wire draw nib having a throughbore for drawing wire and a draw nib holder wherein the draw nib holder has a front end and a back end relative to a wire drawing direction of the assembly, a cylindrical opening with a threaded peripheral wall extending into the holder from said front end, and a converging passageway leading from said cylindrical opening toward said back end of the holder for receiving the draw nib, wherein the draw nib has a tapering outer surface to fit in said passageway and wherein the assembly further includes thread-in means for threading into said cylindrical opening and removably pressing the draw nib into said passageway, wherein the thread-in means comprises a combination of a pressure nib and a pressure nib holder, the pressure nib holder having a threaded outer surface for threading into said cylindrical opening and a bore in a rear portion thereof receiving the pressure nib, the pressure nib projecting from said bore to press against the draw nib, wherein said bore in the rear portion of the pressure nib holder leads from a lubricant inlet passage in a front portion of the pressure nib holder with a shoulder between the bore and said lubricant inlet passage, the pressure nib having a front end to engage said shoulder, wherein the pressure nib has a further throughbore for passage of wire stock to said throughbore in the draw nib, wherein a back portion of the throughbore in the pressure nib and a forward portion of the throughbore in the draw nib together define a pressure chamber for lubricant delivered through said lubricant inlet passage; and wherein a projecting portion of the pressure nib is tapered to seat in a tapered recess formed in a front end of said converging passageway in the draw nib holder.

2. An assembly as defined in claim 1, wherein said back portion of the throughbore in the pressure nib diverges from a point of minimum diameter of the throughbore toward a back end of the pressure nib and wherein the throughbore in the draw nib converges from a front end of the draw nib towards a point of minimum diameter of the throughbore.

3. An assembly as defined in claim 1, wherein the draw nib holder has a frusto-conical outer surface converging toward a backward portion of the draw nib holder.

4. An assembly as defined in claim 1, wherein a portion of the draw nib holder and a portion of the pressure nib holder are each of non-circular cross-section to facilitate threading and unthreading of the holders.

5. An assembly as claimed in claim 1, wherein said projecting portion of the pressure nib and said tapered recess are differentially tapered.

6. A wire drawing die assembly comprising a pressure nib and a draw nib carried by holder means with a back end of the pressure nib engaging a front end of the draw nib in a drawing direction of the assembly, a wire-passing throughbore in the pressure nib communicating with a wire-drawing throughbore in the draw nib wherein a back portion of the throughbore in the pressure nib and a front portion of the throughbore in the draw nib together define a pressure chamber for lubricant introduced through a front portion of the throughbore in the pressure nib during wire drawing, wherein the holder means comprises a pressure nib holder for the pressure nib and a draw nib holder for the draw nib with a threaded connection between the holders, wherein the pressure nib projects from a rear end of the pressure nib holder and presses the draw nib into a converging passageway in the draw nib holder, and wherein a projecting portion of the pressure nib is tapered to seat in a tapered recess formed in a front end of said converging passageway in the draw nib holder.

7. An assembly as claimed in claim 6, wherein said projecting portion of the pressure nib and said tapered recess are differentially tapered.

8. An assembly as claimed in claim 6, wherein said throughbore in the pressure nib and said throughbore in the draw nib each comprises a convergent-divergent throughbore.

* * * * *